United States Patent [19]

Schmidt

[11] Patent Number: 4,930,234

[45] Date of Patent: Jun. 5, 1990

[54] FOLDABLE I.D. CARD

[75] Inventor: Eric Schmidt, Elgin, Ill.

[73] Assignee: Wallace Computer Services, Inc., Hillside, Ill.

[21] Appl. No.: 349,050

[22] Filed: May 8, 1989

[51] Int. Cl.[5] ..... A44C 3/00

[52] U.S. Cl. ..... 40/1.5; 40/638

[58] Field of Search ..... 40/1.5, 630, 638

[56] References Cited

U.S. PATENT DOCUMENTS

| | | | |
|---|---|---|---|
| 2,242,736 | 5/1941 | Wilder et al. . | |
| 2,767,495 | 10/1956 | Harris | 40/638 |
| 2,975,538 | 3/1961 | Murfin | 40/1.5 X |
| 3,197,898 | 8/1965 | Blish | 40/638 |
| 3,295,235 | 1/1967 | Tauber | 40/1.5 |
| 3,946,507 | 3/1976 | Fergg et al. | 40/638 |

FOREIGN PATENT DOCUMENTS

| | | | |
|---|---|---|---|
| 238852 | 7/1959 | Australia | 40/1.5 |

*Primary Examiner*—Laurie K. Cranmer

*Attorney, Agent, or Firm*—Tilton, Fallon, Lungmus & Chestnut

[57] ABSTRACT

An I.D. card capable of conversion in use to three different aspects or configurations wherein a relatively elongated paperboard panel is equipped with a transversely extending line of weakness employed for folding the relatively elongated panel into a version suitable for breast pocket mounting, the section normally inserted into the breast pocket being equipped with a band of pressure sensitive adhesive immediately adjacent the line of weakness for securing a part of the pocket section to the remainder of the panel so as to develop an advantageous Y configuration of I.D. card.

10 Claims, 1 Drawing Sheet

FOLDABLE I.D. CARD

BACKGROUND AND SUMMARY OF INVENTION:

This invention relates to an I.D. card and more particularly one that is suitable for mounting in a wearer's breast pocket.

I.D. cards, nametags and the like have been marketed in a variety of forms. An early version for a pocket-received ticket is Pat. No. 2,242,736.

The instant invention has to do with a name identification device which is capable of multiple uses. In one aspect, through the provision of an advantageously located transverse band of adhesive, a Y configuration can be developed to assist in immobilizing the I.D. card in the breast pocket of a wearer. In another aspect of the same basic construction, a larger area of adhesive can be exposed on the pocket section to anchor the I.D. card in place in a wearer's breast pocket. Still further, through the use of a line of weakness, the name section can be detached from the remainder of the basic panel to provide a conventional name tag pastable on the garment of a wearer.

Other objects and advantages of the invention may be seen in the ensuing specification.

The invention is illustrated in the accompanying drawing, in which

Figure 1:
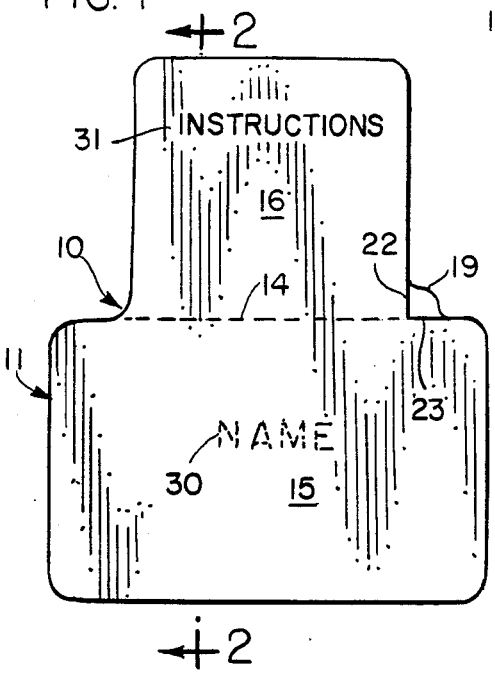
FIG. 1 is a front elevational view of the inventive I.D. card.
Figure 2:
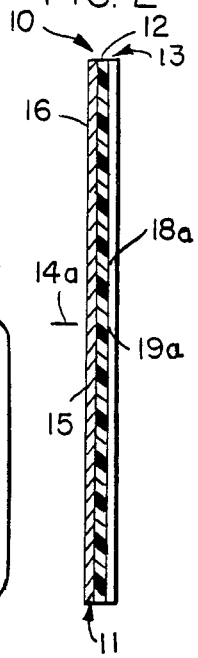
FIG. 2 is a sectional view taken along the sight line 2—2 of FIG. 1.
Figure 3:
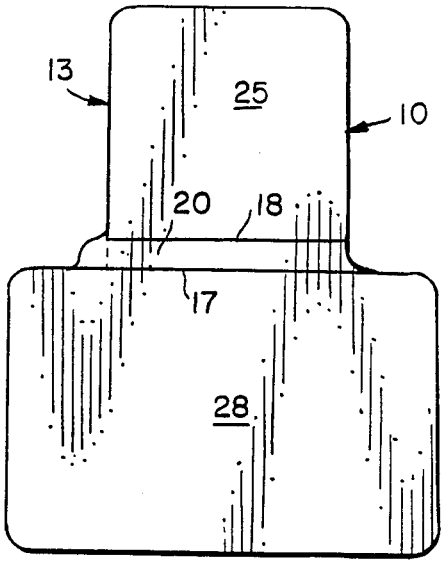
FIG. 3 is a rear elevational view.

DETAILED DESCRIPTION:

In the illustration given and with reference first to FIGS. 1-3, the numeral 10 designates generally the inventive I.D. card which is seen to include a panel generally designated 11 and which constitutes the front of the I.D. card. Advantageously, this may be constructed of a fibrous material such as coated paperboard. Other materials of construction may be employed such as plastic, film, etc. which are sufficiently rigid to stand up in use as a nametag but which are readily foldable for the purposes to be described hereinafter.

The numeral 12—see FIG. 2—designates a layer of pressure sensitive adhesive which is applied to the rear face of the panel 11 and, in the illustration given, extends over the entire rear surface thereof.

The numeral 13 (still referring to FIG. 2) designates generally a sheet of release liner such as a silicone coated film which is removable by peeling from the pressure sensitive adhesive. The peeling removal of the release liner sheet—or a portion thereof—exposes the pressure sensitive adhesive.

Referring again to FIG. 1, it will be seen that the I.D. card 10 is relatively elongated and, intermediate the ends, is equipped with a line of weakness 14 which is located intermediate the ends of the panel 11. In the illustration given, this is a line of perforation which can be appreciated from the dashed line **14*a*** applied to FIG. 2. It is about this line of weakness that the I.D. card can be folded in one aspect of use.

The line of weakness 14 divides the panel 11 into a name section 15 and a pocket section 16 and it will be noted that the transverse dimension of the generally rectangular section 15 is somewhat greater than the transverse dimension of the generally rectangular pocket section 16.

Referring now to FIG. 3, it will be seen that the release liner sheet 13 is equipped with a pair of die cuts as at 17 and 18. That these extend completely through the release liner can be appreciated from a consideration of the solid line showings as at **17*a* and 18*a*** in FIG. 2.

Figure 4:
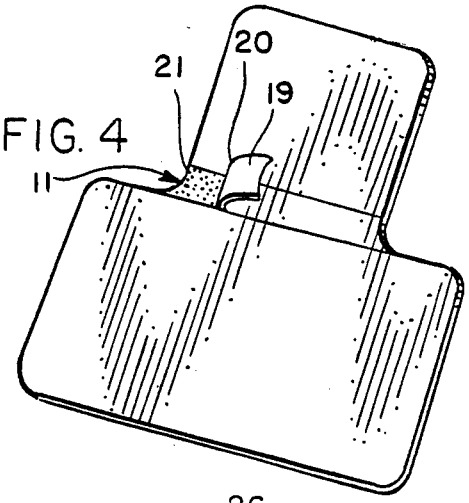
FIG. 4 is a perspective view of the inventive I.D. card in the process of having a release liner detached for conversion to a first aspect of use.

Referring again to FIG. 1, it will be seen that the panel 11 immediately above the line of weakness 14 is extended laterally as at 19 to provide a finger gripping means for removing a transverse strip 20 of the release liner 13 so as to expose a transversely extending band of pressure sensitive adhesive 21—see FIG. 4. To facilitate this operation, the panel 11 is die cut as at 22 along a longitudinally extending line and as at 23 along a transversely extending line.

First Aspect

To achieve one configuration of I.D. card, the strip 20 of release liner is peelingly removed from the panel 11 in the fashion illustrated in FIG. 4. Because the finger gripping means 19 is severed from the remainder of the panel 11 by the die cuts 22, 23, it accompanies the liner strip 20. Thereafter, the panel 11 is folded along the line of weakness 14—as indicated at **14*b* in FIG. 5—to develop what might be considered a Y configuration. In other words, the major portion of the name panel 15 constitutes one arm of the Y and the major portion of the pocket panel 16 constitutes the other arm of the Y. The base of the Y is relatively short and is made up as illustrated at 24 in FIG. 5 by the adhered portions of the sections 15, 16 immediately adjacent the line of weakness 14. This then develops an advantageous clamping action in the pocket section 16 inasmuch as the unadhered portion tends to assume a co-planar relationship with the adhered portion, viz., the portion 16*a* tends to conform to the portion 16*b***.

Second Aspect

Another configuration of use of the inventive I.D. card can be achieved through removing yet another part of the release liner 13 as at 25. This is illustrated in process in FIG. 6 where the part 25 is seen in the process of being removed from a portion of the pocket section 16 so as to expose a part of the pressure sensitive adhesive as at 26. Then when the I.D. card 10 is folded on the line of weakness 14—see FIG. 7—there is provided a face of the pocket section 16 equipped with pressure sensitive adhesive which can be adhered to the inside of the pocket of a wearer, the flat of the breast pocket being shown fragmentarily and designated 27.

Figure 8:
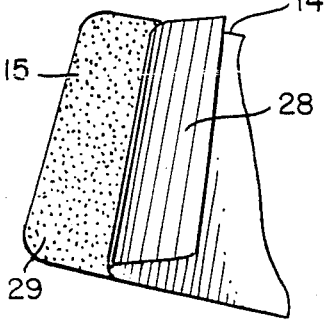
FIG. 8 is a fragmentary perspective view showing detachment of yet another portion of the release liner for presentation of the I.D. card in a third aspect of use.

Third Aspect

Where the intended wearer of the I.D. card does not have a breast pocket in his or her garment, a more conventional type of nametag can be developed from the inventive construction. This is illustrated in FIG. 8 where the name section 15 has been detached from the pocket section (not shown in FIG. 8) by tearing along the line of weakness 14. The part 28 of the release liner can then be peelingly removed as illustrated in FIG. 8 to expose part of the pressure sensitive adhesive at 29, resulting on a paste-on tag or label.

SUMMARY OF OPERATION

In the practice of the invention I provide an I.D. card particularly suited for breast pocket installation which includes a unitary, foldable generally elongated panel 11 equipped with a transversely extending line of weakness 14 intermediate the ends of the panel. This defines a name section 15 on one side of the line of weakness and a pocket section 16 on the other side of the line of weakness. One face of the panel 11 is equipped with name indicia as at 30 on the name section 15 and operating instructions 31 on the front of the pocket section 16.

The reverse face of the panel 11 is equipped at least with a transversely extending band of pressure sensitive adhesive 21 adjacent the line of weakening 14 and on the side thereof defining the pocket section 16. The transversely extending band of adhesive 21 is covered by a strip of release line 20 which removably covers the same and which advantageously includes a finger gripping means 19 die cut as at 22, 23 from the panel 11.

Figure 5:
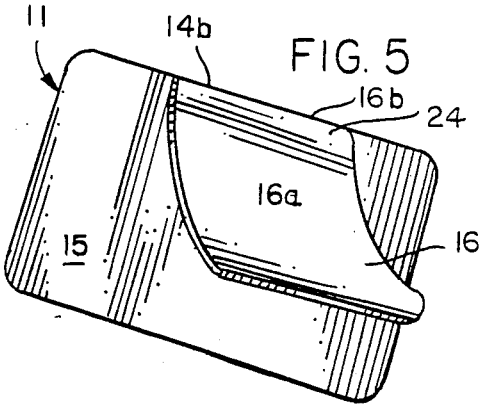
FIG. 5 is a perspective view of the I.D. card of FIG. 4 in its completed form for insertion into the breast pocket of a wearer.

When the release liner strip 20—see FIG. 4—is removed, and the panel folded on the line of weakness 14 as at **14*b* in FIG. 5, the band of adhesive 21 adheres the portion 16*b* of the pocket section 16 to a portion of the name section 15** immediately adjacent the line of weakness to develop a generally Y configuration tending to close so as to immobilize the folded panel in breast pocket mounting.

Figure 6:
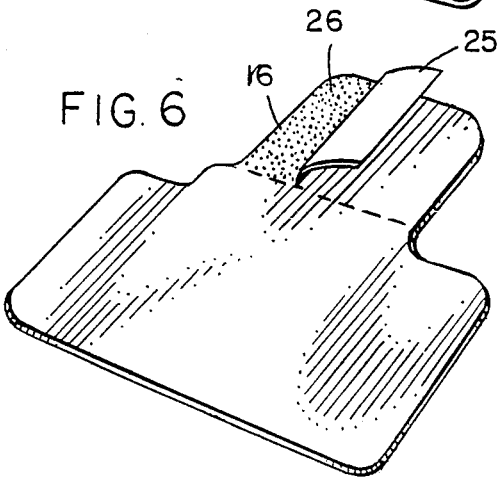
FIG. 6 is a view similar to FIG. 4, i.e., being a perspective view of the inventive I.D. card with another portion of the release line being in the process of removal so as to convert the a second aspect of use.
Figure 7:
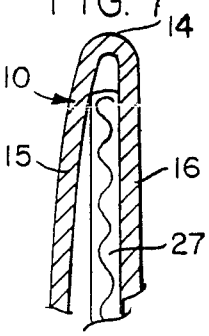
FIG. 7 is a perspective view, partially in section of the completed reshaped I.D. card of FIG. 6 and shown installed on the breast pocket of a wearer's garment.

Two other usages or aspects of the invention can be achieved. As seen in FIGS. 6 and 7, a part 25 of the release liner can be removed to expose pressure sensitive adhesive 16 on the reverse face of the pocket section 16 so as to anchor the pocket section on the inside of the pocket patch or flap 27—see FIG. 7.

Still further, the name section 15 can be separated along the line of weakness 14 from the pocket section 16 and, as seen in FIG. 8, a portion 28 of the release liner 13 can be peeled away so as to expose pressure sensitive adhesive 29. Thereafter, the generally rectangular name section can be used as a more or less conventional name label by application to the garment of a wearer.

In the illustrated and preferred embodiment of the invention, the width of the name section 15 is approximately 3⅜" while that of the pocket section is about 2⅛", being centered over the name section 15. The height of the name section 15 is approximately 2⅛" while that of the pocket section 16 is about 2". All of the corners are beveled or curved as illustrated to avoid edges that might engage the garment fabric of the wearer. The panel 16 is extended in the finger gripping means area 19 about 5/16" both laterally and longitudinally to provide the tab 19 and thus the band of adhesive 21 which is exposed is of the order of about ¼". I have found this eminently suitable for adhering the part **16*b* of the pocket section 16 to the part of the name section 15 immediately adjacent the line of weakness 14. It will be appreciated that when all three aspects of the invention are to be achieved, the rear of the name section 15 is equipped with a release liner which is not removed when the Y configuration is developed. Thus, the ¼" wide band of pressure sensitive adhesive as at 21** is sufficient to maintain the general Y shape.

While in the foregoing specification a detailed description of the invention has been set down for the purpose of illustration, many variations in the details hereingiven may be made by those skilled in the art without departing from the spirit and scope of the invention.

I claim:

1. A breast pocket I.D. card comprising a unitary, foldable generally elongated panel equipped with a transversely-extending line of weakness intermediate the ends thereof to define a name section on one side of said line and a pocket section on the other side thereof, each of said sections being generally rectangular with the transverse dimension of said name section being greater than the transverse dimension of said pocket section, one face of said panel being equipped with a transversely-extending name information space on said name section, the other face of said panel on said pocket section being equipped with a transversely extending band of pressure sensitive adhesive adjacent said line of weakening, and a release liner removably covering said adhesive whereby, when said release liner is removed, said panel is foldable on said line of weakness with said band of adhesive adhering the portion of said pocket section adjacent said line of weakness to the portion of said name section adjacent said line of weakness to develop a generally Y configuration tending to close to immobilize the folded panel in breast pocket mounting.

2. The I.D. card of claim 1 in which said panel is extended transversely at one longitudinal edge thereof in alignment with said band of adhesive to provide finger gripping means for removal of said liner, said panel being equipped with longitudinally-extending and transversely extending die cuts for separating said finger gripping means from the remainder of said panel, said finger gripping means on said other face being equipped with pressure sensitive adhesive and a continuation of said liner, said name section extending transversely beyond said finger gripping means.

3. The I.D. card of claim 1 in which said other face of said name section is equipped with pressure sensitive adhesive and a release liner in removable, covering relation thereto whereby when said panel sections are separated along said line of weakness, a name tag results from said name section which can be applied to the exterior of a wearer's garment upon removal of the last mentioned release liner.

4. The I.D. card of claim 3 in which said line of weakness is a line of perforation.

5. The I.D. card of claim 4 in which said release liner covering said band of adhesive and the release liner covering said name section other faces are developed from a single liner sheet, and a die cut in said liner sheet between the part covering said band of adhesive and the part covering said name section other face.

6. The I.D. card of claim 1 in which the other face of said pocket section is equipped with pressure sensitive adhesive extending from said band to the end of said pocket section, and a release liner in removable covering relation thereto whereby, when the last mentioned release liner is removed, said pocket section is temporarily securable to the interior of a wearer's pocket.

7. The I.D. card of claim 6 in which said release liner covering said band of adhesive and the release liner covering said pocket section other face developed from a single liner sheet, and a die cut in said liner sheet between the part covering said band of adhesive and the part covering said pocket section other face.

8. The I.D. card of claim 1 in which the one face of said pocket is equipped with operating instruction indicia.

9. A breast pocket I.D. card comprising a unitary, relatively elongated paperboard panel having an information face and a face opposite coated with pressure sensitive adhesive, a transversely extending line of perforation intermediate the panel ends dividing said panel into a name section and a pocket section, transversely extending name information on said name section, each of said sections being generally rectangular with the transverse dimension of said name section being greater than the transverse dimension of said pocket section, a release liner covering said adhesive and equipped with two transversely extending die cuts, a first die cut being aligned with said line of perforation and the second being spaced approximately $\frac{1}{4}''$ from said first die cut and positioned in said pocket section whereby removal of said liner between said die cuts exposes a band of adhesive for adhering said pocket section opposite face to said name section opposite face upon folding of said panel on said line of perforation.

10. The I.D. card of claim 9 in which said name section is wider than said pocket section, said panel in said pocket section between said die cuts being laterally extended to provide a finger gripping means for removal of said liner between said die cuts, said panel inward of said finger gripping means being equipped with longitudinally and transversely extending die cuts.

* * * * *